US007051440B2

(12) United States Patent
Bremicker et al.

(10) Patent No.: US 7,051,440 B2
(45) Date of Patent: May 30, 2006

(54) TOOL DEVICE

(75) Inventors: Christian Bremicker, Wetter (DE); Renny Tse-Haw Ling, Taipei (TW); Yung-Li Kuo, Taipei (TW); Chi-Chang Tsai, Taipei (TW)

(73) Assignees: Sinox Co., Ltd., Taipei (TW); AUG. Bremicker Sohne KG, Wetter (DE)

( * ) Notice: Subject to any disclaimer, the term of this patent is extended or adjusted under 35 U.S.C. 154(b) by 0 days.

(21) Appl. No.: 10/761,357

(22) Filed: Jan. 22, 2004

(65) Prior Publication Data

US 2005/0081689 A1 Apr. 21, 2005

(30) Foreign Application Priority Data

Oct. 17, 2003 (TW) ..... 92218504 U

(51) Int. Cl.
*B26B 3/06* (2006.01)
*E05B 73/00* (2006.01)

(52) U.S. Cl. ..... 30/161; 70/61; 70/28

(58) Field of Classification Search ..... 30/160, 30/161; 70/28, 61, 174, 207, 208, 209, 456 R, 70/459; D8/99
See application file for complete search history.

(56) References Cited

U.S. PATENT DOCUMENTS 1,859,158 A * 5/1932 Pernek, Sr. ..... 30/163
2,189,342 A * 2/1940 Eber ..... 70/3
3,684,117 A * 8/1972 Leopoldi et al. ..... 70/232
4,120,088 A * 10/1978 Phelps ..... 30/160
4,451,982 A * 6/1984 Collins ..... 30/161
4,473,176 A * 9/1984 Harper ..... 70/61
4,926,555 A * 5/1990 Lemaire ..... 30/162
5,368,406 A * 11/1994 Hanshaw ..... 70/61
5,765,409 A * 6/1998 Yang ..... 70/28
6,227,016 B1 * 5/2001 Yu ..... 70/30
6,293,448 B1 9/2001 Pietrusynski
6,363,615 B1 * 4/2002 Moser ..... 30/161
6,796,033 B1 * 9/2004 Owoc ..... 30/162
6,880,371 B1 * 4/2005 Huang ..... 70/28

* cited by examiner

*Primary Examiner*—Allan N. Shoap
*Assistant Examiner*—Jason Prone
(74) *Attorney, Agent, or Firm*—Birch, Stewart, Kolasch & Birch, LLP

(57) ABSTRACT

A tool device includes a main body, a cutting member and a locking mechanism. The main body is formed with a receptacle for receiving the cutting member. The cutting member is movably mounted on the main body and selectively moves between a first position of being received in the main body and a second position of being removed from the receptacle and ready to use. The locking mechanism is mounted on the main body and changeable between a locking mode and a release mode. In the locking mode, the cutting member cannot be moved from the first position to the second position. While, in the release mode, the cutting member is free to move to the second position for use.

5 Claims, 13 Drawing Sheets

TOOL DEVICE

This Non-provisional application claims priority under 35 U.S.C. §119(a) on Patent Application No(s). 92218504 filed in Taiwan on Oct. 17, 2003, the entire contents of which are hereby incorporated by reference.

BACKGROUND OF THE INVENTION

1. Field of the Invention

The invention generally relates to a tool device, and in particular relates to a foldable hand tool.

2. Related Art

Hand tools are applied for different working purposes by users. Some tools include sharp blades or pointed portions that may cause injury to the users. In order to prevent from danger, hand tools have to be used correctly. The dangerous portions also require to be covered after being use so as to prevent from being touched unintentionally.

For the sake of safety, most hand tools having blades, saws or sharp portions are designed with foldable portions. For example, a foldable knife has a blade foldable or retractable into the handle so as to prevent unintentional harm to people. The foldable mechanism is preferred to be compact for easy carrying or storage.

Though a common foldable hand tool, such as a foldable knife, is safer when being used and folded correctly by careful users, it still causes danger to children or infants who move the knife out. Therefore, the safety of conventional foldable hand tool is still a problem to be solved.

An improvement to the knife safety is disclosed in U.S. Pat. No. 6,293,448, entitled "Mountable locking knife scabbard". It includes a locking carrying frame, knife sheath, knife, and locking pin. The locking carrying frame has one slot to facilitate fastening to a surface. The knife sheath is fastened to the locking carrying frame. The knife sheath is sized to receive the knife. The knife and locking carrying frame have openings formed through thereof to receive a locking pin. The locking pin has a head on one end and a bolt opening formed through the other end which is sized to receive a padlock bolt. When the padlock bolt is inserted through the bolt opening; the padlock does not allow the knife to be withdrawn from the knife sheath. The above construction is not easy to use because the padlock bolt has to be first removed before releasing the locking pin when going to use the knife; and, after using, the locking pin has to be first inserted in place and then secured with the padlock bolt. Further, the knife and the sheath are separate, the knife sheath is easy to be lost.

SUMMARY OF THE INVENTION

The object of the invention is to provide a hand tool device that includes safety protection function and is easy to operate.

A tool device according to the invention includes a main body, a cutting member and a locking mechanism. The main body is formed with a receptacle for receiving the cutting member. The cutting member is movably mounted on the main body and selectively moves between a first position of being received in the main body and a second position of being removed from the receptacle and ready to use. The locking mechanism is mounted on the main body and changeable between a locking mode and a release mode. In the locking mode, the cutting member cannot be moved from the first position to the second position. While, in the release mode, the cutting member is free to move to the second position for use.

The tool device of the invention is applicable to foldable hand tools that include dangerous cutting members. The locking mechanism of the invention keeps the cutting member in a folded and safe position that can be moved to a working position only when the user intends to release the locking mechanism.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The tool device of the invention is applicable to foldable hand tools, such as blades, saws, screwdrivers and so on. Though the illustrations of the following embodiments are knifes, the applications of the invention are certainly not limited to knifes only.

FIRST EMBODIMENT

As shown in FIGS. 1 to 4, a tool device according to the invention includes a main body 10, a cutting member 20, a locking mechanism 30 and a connecting member 40.

Figure 2:
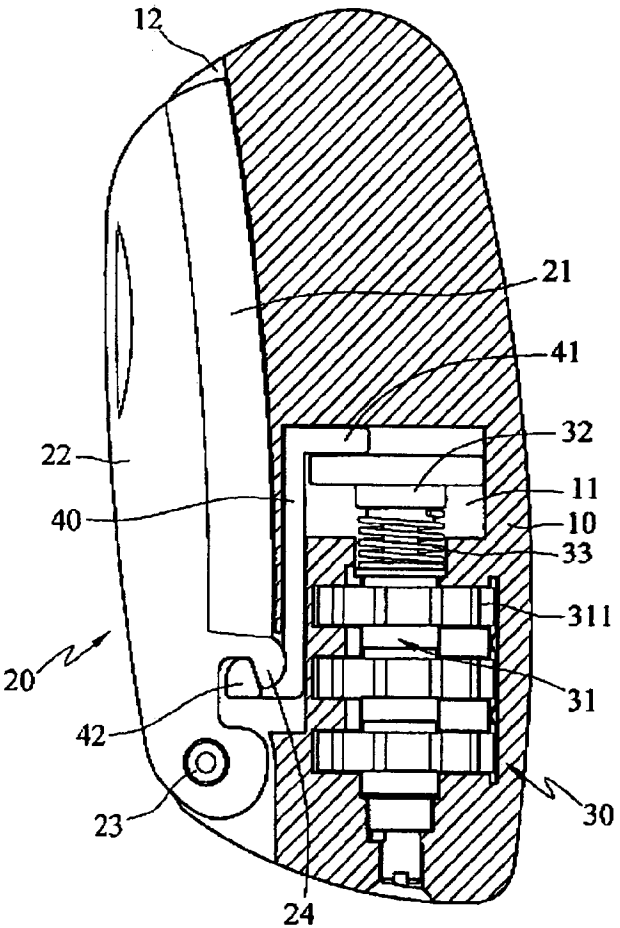
FIG. 2 is a constructional view of a first embodiment of the invention in which a cutting member is in a first position.
Figure 4:
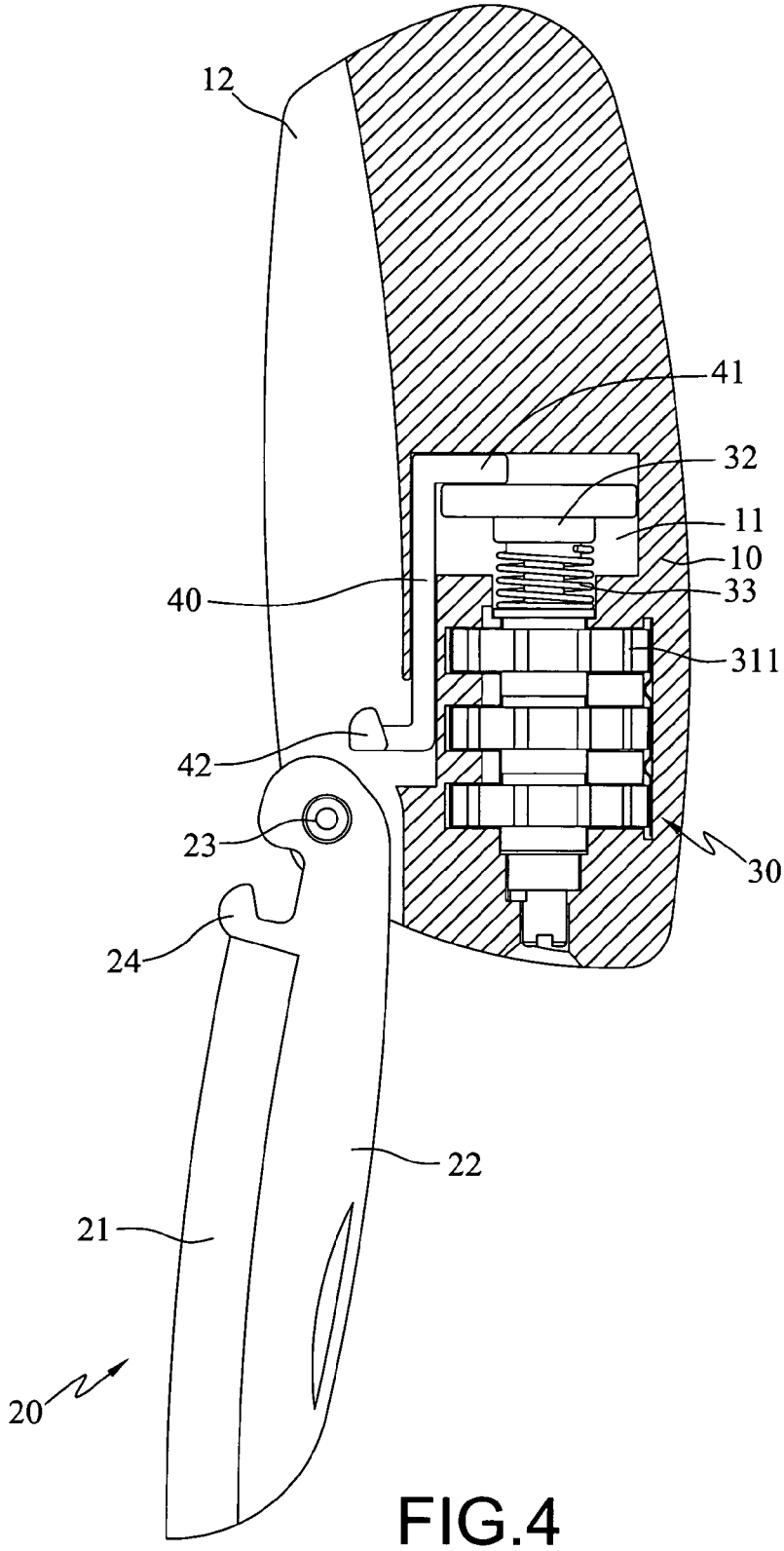
FIG. 4 is a constructional view of a first embodiment of the invention in which the cutting member is in the second position.

The main body 10 is formed with a cavity 11 for mounting the locking mechanism 30, and a receptacle 12 for receiving the cutting member 20. The cutting member 20 is mainly a blade having an edge 21, a back 22, a pivot 23 and a limiting portion 24. The cutting member 20 is pivotally mounted on the main body 10 via the pivot 23 and selectively moves between a first position (as shown in FIG. 2) of being received in the receptacle 12 and a second position (as shown in FIG. 4) of being removed from the receptacle 12 and ready to use. In the first position, the edge 21 of the cutting member 20 is received in the receptacle 12; only the back 22 exposes that won't harm the user. In the second position, the edge 21 of the cutting member 20 exposes from the main body 10; the user holds the main body 10 and operates the edge 21 to do works like cutting or paring.

The locking mechanism 30 is mounted on the main body 10 and changeable between a locking mode and a release mode. It can be a numbering lock or a key lock operated by user. In the first embodiment, a numbering lock is shown. The lock mechanism 30 includes a controller 31, a latch 32 and a resilient member 33. The controller 31 is composed of a plurality of number wheels 311 each formed with an unshown tunnel for the latch 32 passing through. The latch 32 moves relatively to the number wheels 311 between a locking position (as shown in FIG. 2) and a release position (as shown in FIG. 4), and normally remains in the locking position by force of the resilient member 33.

When all the number wheels 311 are dialed to predetermined positions, the latch 32 is free to move to the release position. When any number wheel 311 is not in a predetermined position, the latch 32 is limited in the locking position. The construction and function of the locking mechanism 30 are of prior arts, and will not be described in details herein.

The connecting member 40 connects the latch 32 and the cutting member 20. The connecting member 40 includes a stopper 41 corresponding to the limiting portion 24, and a pusher 42 corresponding to the latch 32. When the cutting member 20 moves from the first position to the second position, it also moves the latch 32 toward the release position via the connecting member 40.

Figure 5B:
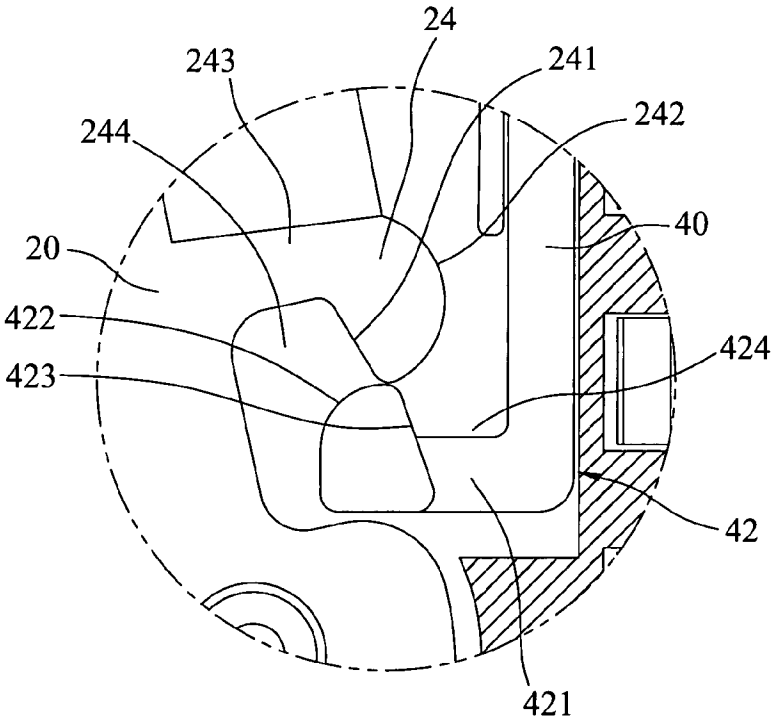
FIGS. 5A and 5B are partial constructional views of a first embodiment of the invention.
Figure 5A:
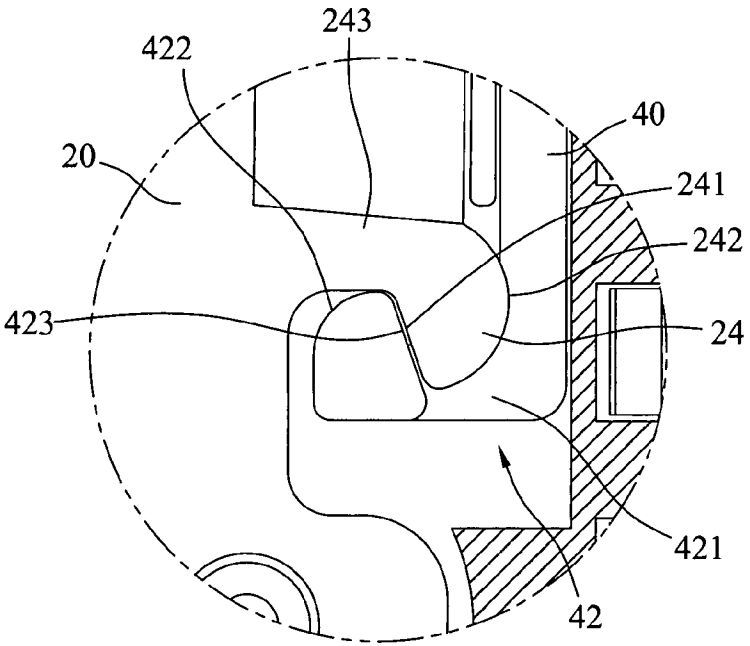

FIGS. 5A and 5B illustrate the arrangements of the limiting portion 24 and the connecting member 40. The limiting portion 24 is substantially a hook extending from the edge 21 and the pivot 23 of the cutting member 20. It is composed of an extended section 243 extended from the cutting member 20; an arc 242 extended from the extended section 243; and a limiting section 241 extended from the arc 242 so as to form a hook 244 on the cutting member 20.

The pusher 42 of the connecting member 40 is also a hook extended from the connecting member 40, and correspondent to the limiting portion 24 of the cutting member 20. The pusher 42 is composed of an extended section 421 extended from the connecting member 40; an arc 422 extended from the extended section 421; and a limiting section 423 extended from the arc 422 so as to form a hook 424 on the connecting member 40.

Based on the pivot 23, the limiting portion 24 moves toward the pusher 42 along a curve. The arc 242 of the limiting portion 24 touches the arc 422 of the pusher 42; a partial force pushes the arc 242 pressing the arc 422 to move the connecting member 40 till the arc 242 of the limiting portion 24 passes over the arc 422 of the pusher 42. Then, the partial force to the connecting member is gone; the connecting member 40 returns to original position and makes the arc 242 of the limiting portion 24 and the arc 422 of the pusher 42 move into the hook 424 and the hook 242. When the arcs 422, 242 move into the hook 424 and 244, the limiting sections 241, 423 of the two contact to each other, and the limiting portion 24 and the pusher 42 are locked. On the contrary, when the cutting member 20 rotates in opposite direction to leave the connecting member 40, a partial force moves the connecting member 40 to let the limiting portion 24 leave the pusher 42.

Figure 1:
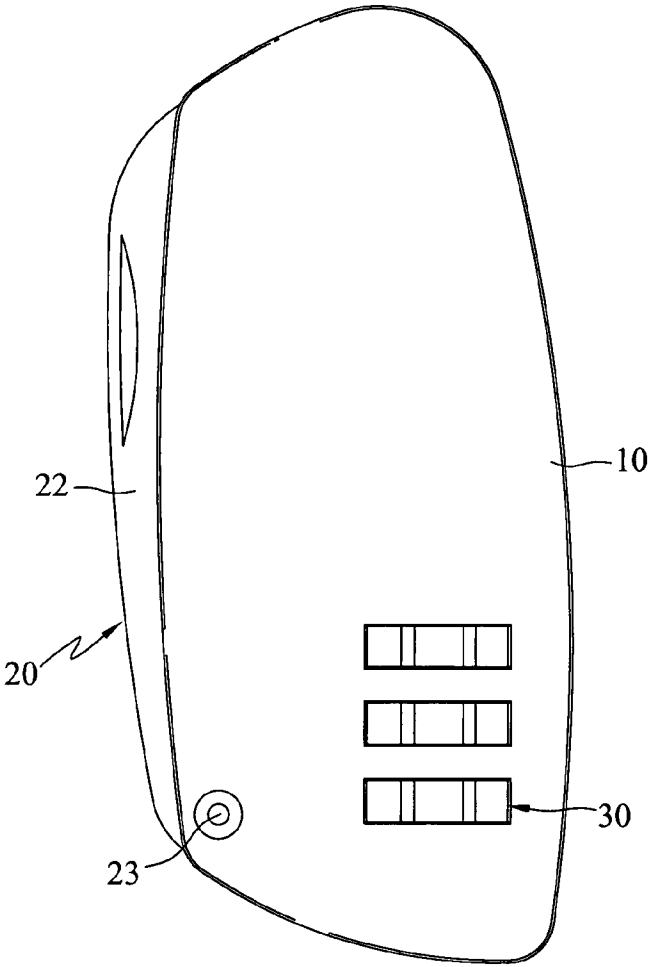
FIG. 1 is an appearance of a first embodiment of the invention.
Figure 3:
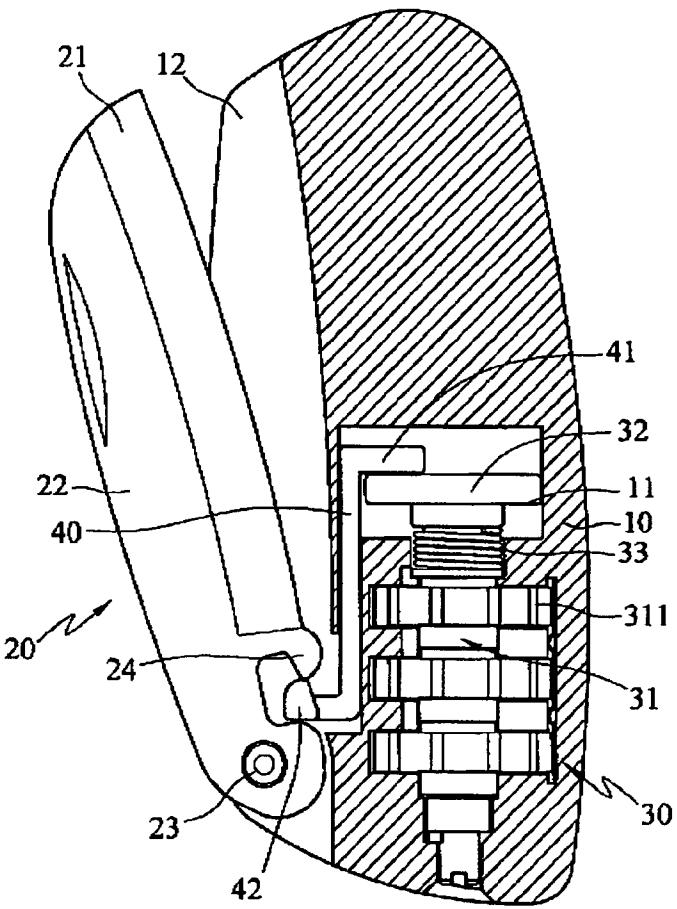
FIG. 3 is a constructional view of a first embodiment of the invention in which the cutting member is being moved from the first position to the second position.

Further referring to FIGS. 2, 3 and 4, when the locking mechanism 30 is in the release mode, and the cutting member 20 is received in the receptacle 12 of the main body 10, the limiting portion 24 of the cutting member 20 locks with the pusher 42 of the connecting member 40. When the user wants to operate the cutting member 20, he or she can move the cutting member 20 out of the main body 10. During the moving, the limiting portion 24 moves the connecting member 40 via the stopper 41; the connecting member 40 also moves the latch 32 toward the release position. After the limiting portion 24 passes over the stopper 41, the latch 32 retrieves to the locking position and pushes the connecting member 40 back by the force of the resilient member 33. Then, the cutting member 20 is moved to the second position for use.

After using the cutting member 20, the user can restore the cutting member 20 to the first position. During the moving, the limiting portion 24 first touches the stopper 41. After further pushing the cutting member 20, the limiting porting 24 pushes the stopper 42; then the connecting member 40 moves the latch 32 toward the release position. After the limiting portion 24 passes over the stopper 42 and moves the cutting member 20 back to the first position, the latch 32 retrieves to the locking position and restores the connecting member 40 by the force of the resilient member 33. The limiting portion 24 is further locked by the pusher 42.

After restoring the cutting member 20 to the first position, the user can dial any number wheel 311 to a position different from the specific position of release mode. Then, the latch 32 is limited in the locking position. The cutting member 20 is therefore secured from unintentional release from the first position to the second position; the edge 21 is secured in the receptacle 12 to prevent danger happening. For an intentional user, he or she can first unlock the locking mechanism 30 to release the latch 32 and move the cutting member 20 out of the main body 10. Also, after using, the cutting member 20 is restored to the first position, then at least a number wheel 311 is reset to lock the latch 32.

SECOND EMBODIMENT

Figure 7:
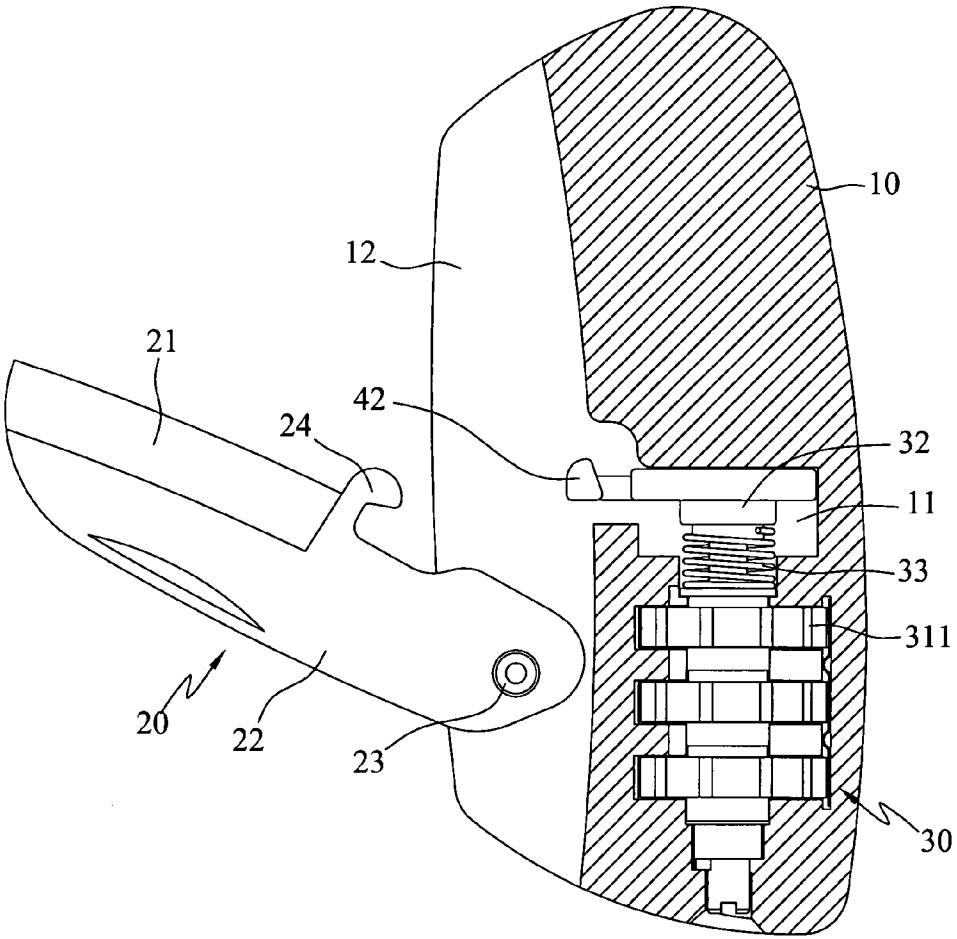
FIG. 7 is a constructional view of a second embodiment of the invention in which a cutting member is in a second position.
Figure 6:
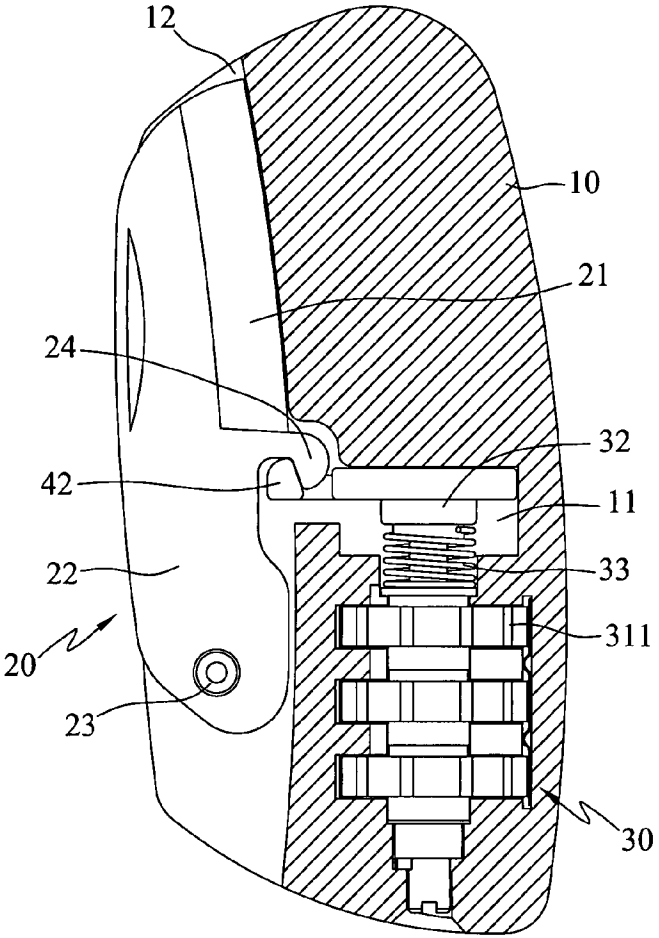
FIG. 6 is a constructional view of a second embodiment of the invention in which a cutting member is in a first position.

FIGS. 6 and 7 illustrate a second embodiment of the invention modified from the first embodiment. In the first embodiment, the cutting member 20 connects to the locking mechanism through the connecting member 40. While, in the second embodiment, the limiting portion 24 of the cutting member 20 directly corresponds to the latch 32 without using a connecting member.

As shown in the drawings, the limiting portion 24 of the second embodiment corresponds to the latch 32. The latch 32 is formed with a pusher 42 corresponding to the limiting portion 24 so that when the cutting member 20 is in the first position, the limiting portion 24 locks with the pusher 42, and the cutting member 20 can move the latch 32 directly.

THIRD EMBODIMENT

Figure 9:
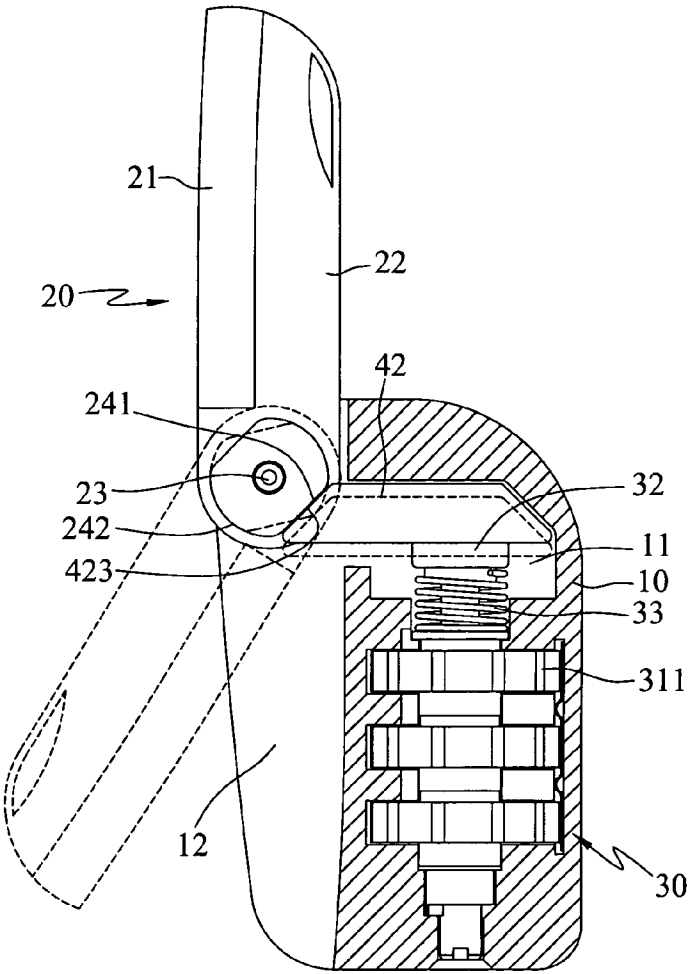
FIG. 9 is a constructional view of a third embodiment of the invention in which a cutting member is in a second position.
Figure 8:
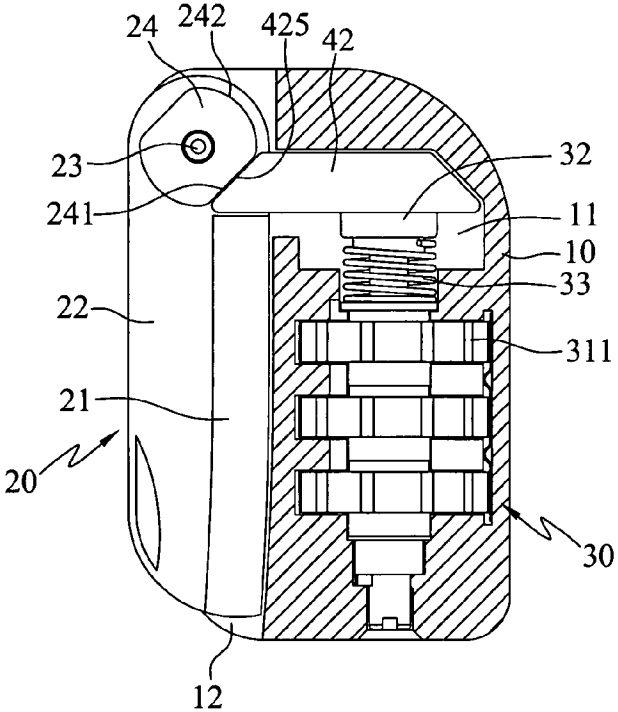
FIG. 8 is a constructional view of a third embodiment of the invention in which a cutting member is in a first position.

FIGS. 8 and 9 illustrate a third embodiment of the invention. The limiting portion 24 is formed on the pivot of the cutting member 20. The limiting portion 24 is substantially round and having two flat cutoffs on opposite sides so as to be defined as limiting sections 241 and arc sections 242. The pusher 42 formed on the latch 32 includes a slope 425 corresponding to the limiting section 241 so that, when the cutting member 20 is in the first position, the limiting section 241 flatly contacts the slope 425 and keeps the cutting member 20 in a stable position. If the locking mechanism 30 is in the locking mode, the latch 32 cannot move; the limiting section 241 contacts with the slope 425 and holds the cutting member 20 in the first position. If the locking mechanism 30 is in the release mode, the cutting member 20 can be forced to move toward the second position. The limiting section 241 presses the slope 425 and moves the latch 32 toward the release position; the limiting portion 24 rotates to make the arc section 242 contact the slope 425 and press the latch 32 to the release position.

FOURTH EMBODIMENT

Figure 11:
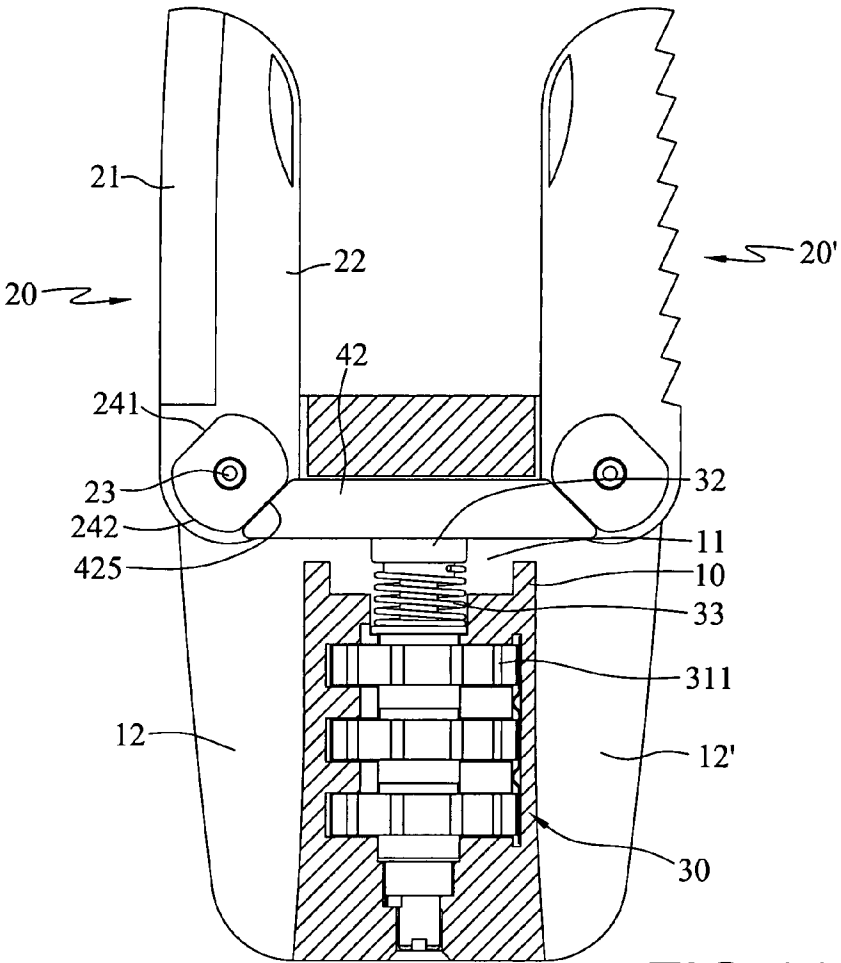
FIG. 11 is a constructional view of a fourth embodiment of the invention in which a cutting member is in a second position.
Figure 10:
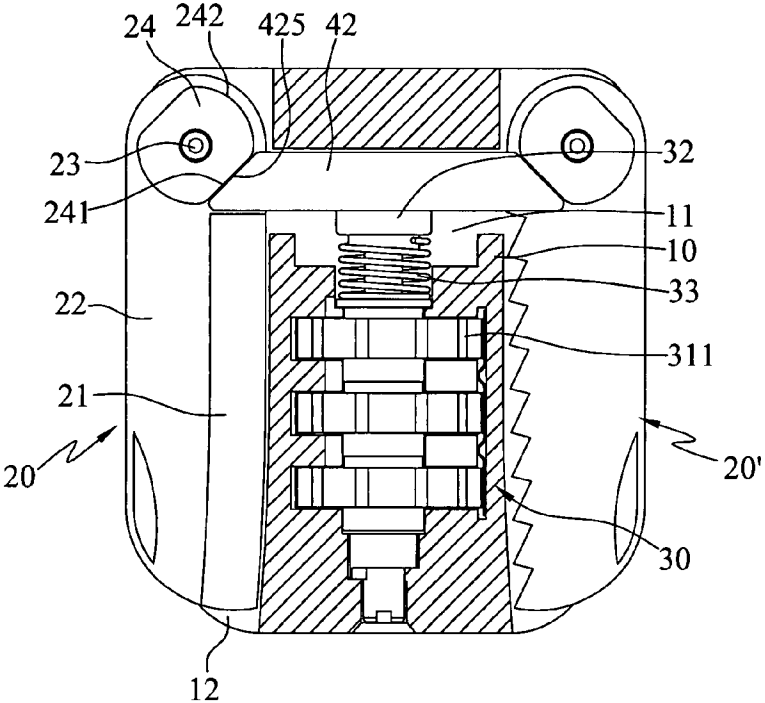
FIG. 10 is a constructional view of a fourth embodiment of the invention in which a cutting member is in a first position.

FIGS. 10 and 11 illustrate a fourth embodiment of the invention modified from the third embodiment. In the third embodiment, only one cutting member 20 is provided. While, in the fourth embodiment, two cutting members are provided.

As shown in the drawings, the main body 10 includes two receptacles 12, 12'. Two cutting members 20, 20' are pivotally mounted on opposite sides of the main body 10. The pusher 42 includes two correspondent slopes 425. The cutting members 20, 20' can be locked by the locking mechanism 30 and secured in the first position when not in use. The cutting members 20 and 21 are for different working purposes, for example a knife and a saw, so as to be a multi-functional hand tool.

FIFTH EMBODIMENT

Figure 12:
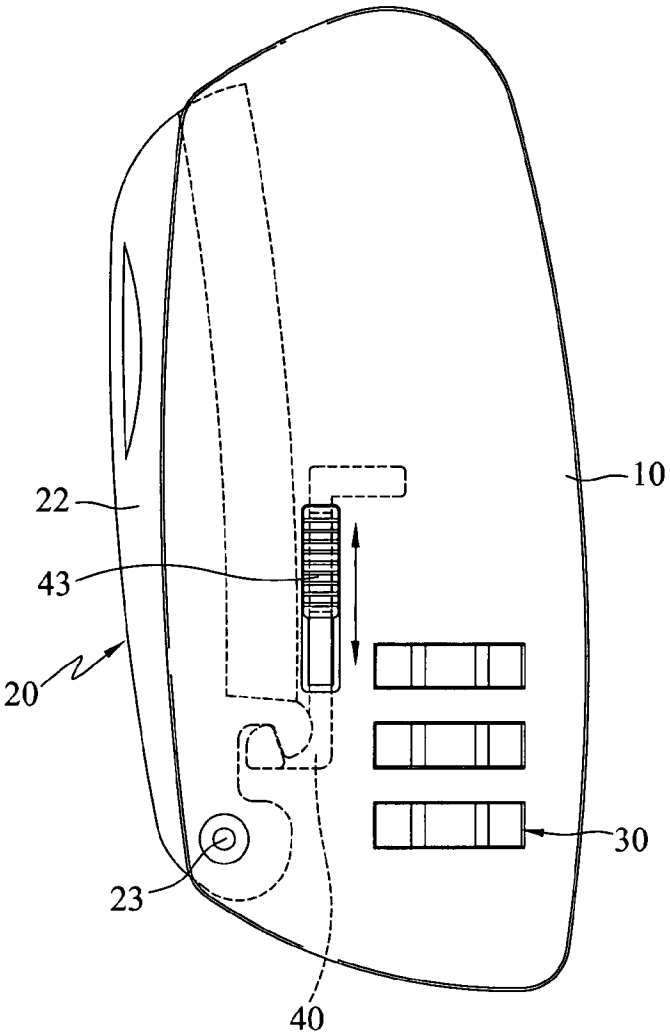
FIG. 12 is a constructional view of a fifth embodiment of the invention.

FIG. 12 shows a fifth embodiment of the invention modified from the first embodiment. In the first embodiment, when the cutting member 20 moves from the first position to the second position, the cutting member 20 activates the connecting member 40 to move the latch 32 toward the release position.

In the fifth embodiment, the connecting member 40 is formed with a knob exposing outward through the main body 10 so that the user can push the knob 43 to control the movement of the cutting member 20 and the latch 32.

SIXTH EMBODIMENT

Figure 14:
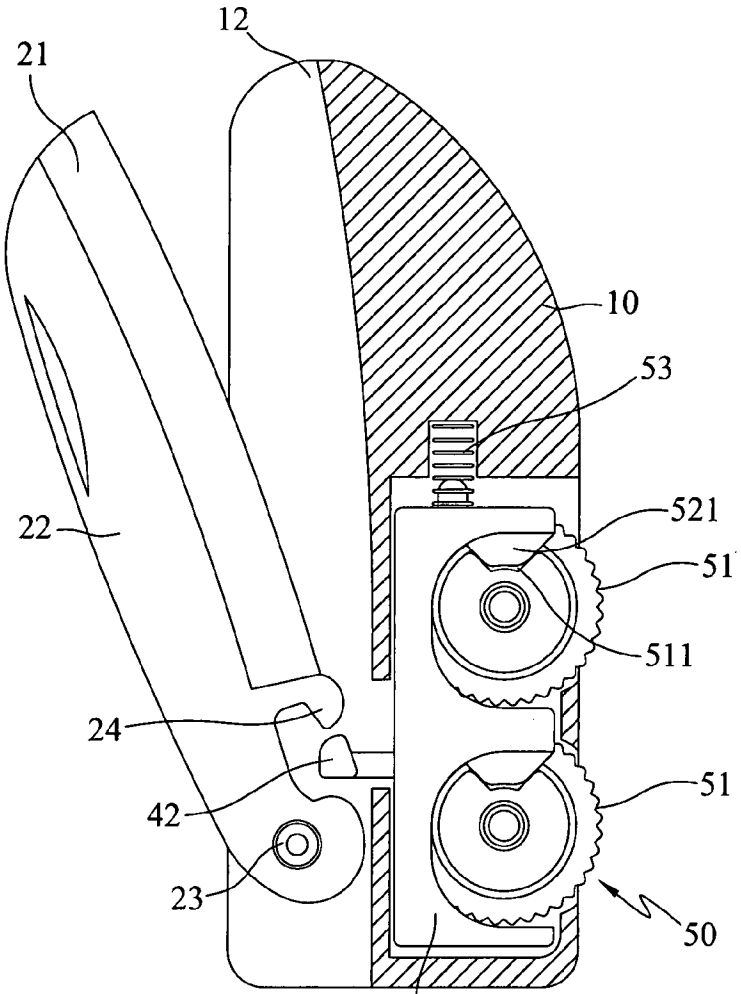
FIG. 14 is a constructional view of a sixth embodiment of the invention in which a cutting member is in a second position.
Figure 13:
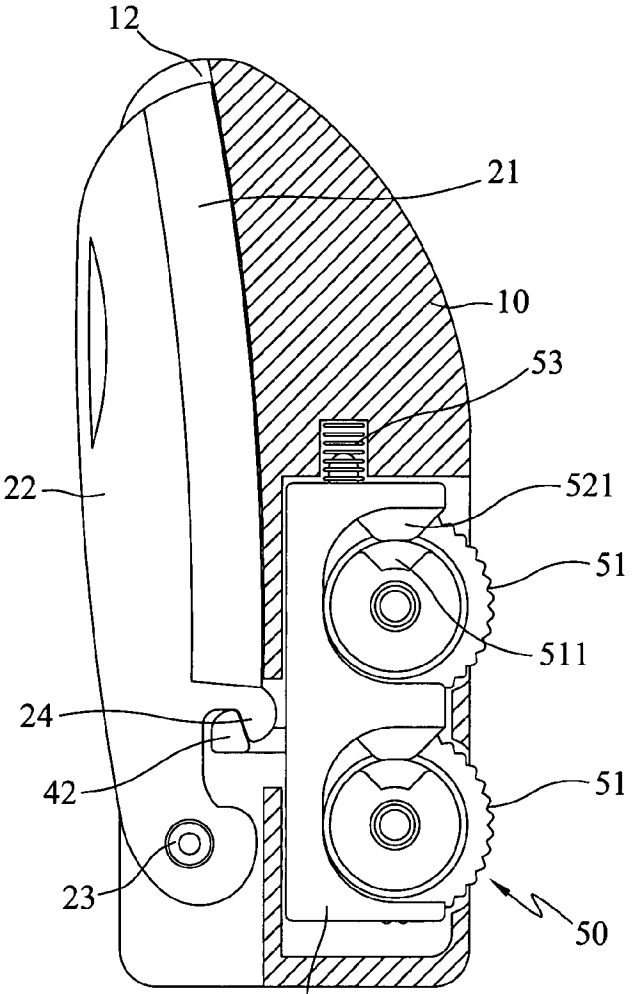
FIG. 13 is a constructional view of a sixth embodiment of the invention in which a cutting member is in a first position.

FIGS. 13 and 14 illustrate a sixth embodiment of the invention having a locking mechanism 50 different from the locking mechanism of the first embodiment. The locking mechanism 50 includes a controller composed of several number wheels 51 mounted in a plane; a latch plate 52 and a resilient member 53. The latch plate 52 and each number wheel 51 are formed with extrusions 521 and cutoffs 511 respectively. When all the number wheels 51 are dialed to make the cutoffs 511 correspond to the extrusions 521 of the latch plate 52, the latch plate 52 is pressed by the resilient member 53 to move toward a release position, as shown in FIG. 13, where the extrusions 521 move into the cutoffs 511. When any number wheel 51 is dialed to any a position where the cutoff 511 does not correspond to the extrusion 521, the latch plate 52 is limited to a locking position, as shown in FIG. 14, that the limiting portion 24 is locked to prevent the cutting member 20 from moving out of the main body 10. The composition and function of the locking mechanism 50 are of prior arts and will not further described in details herein.

SEVENTH EMBODIMENT

Figure 15:
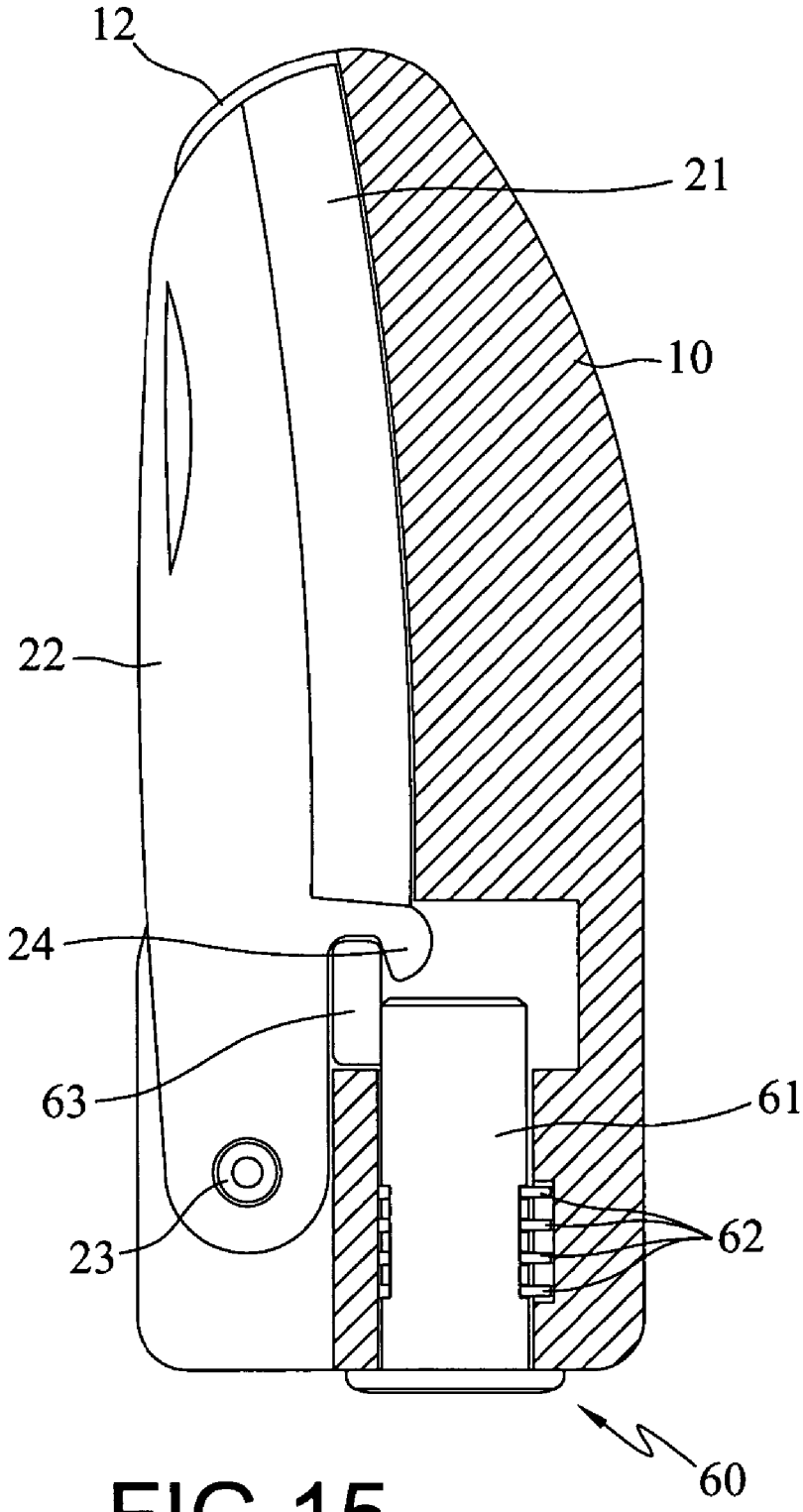
FIG. 15 is a constructional view of a seventh embodiment of the invention in which a cutting member is in a first position.
Figure 16:
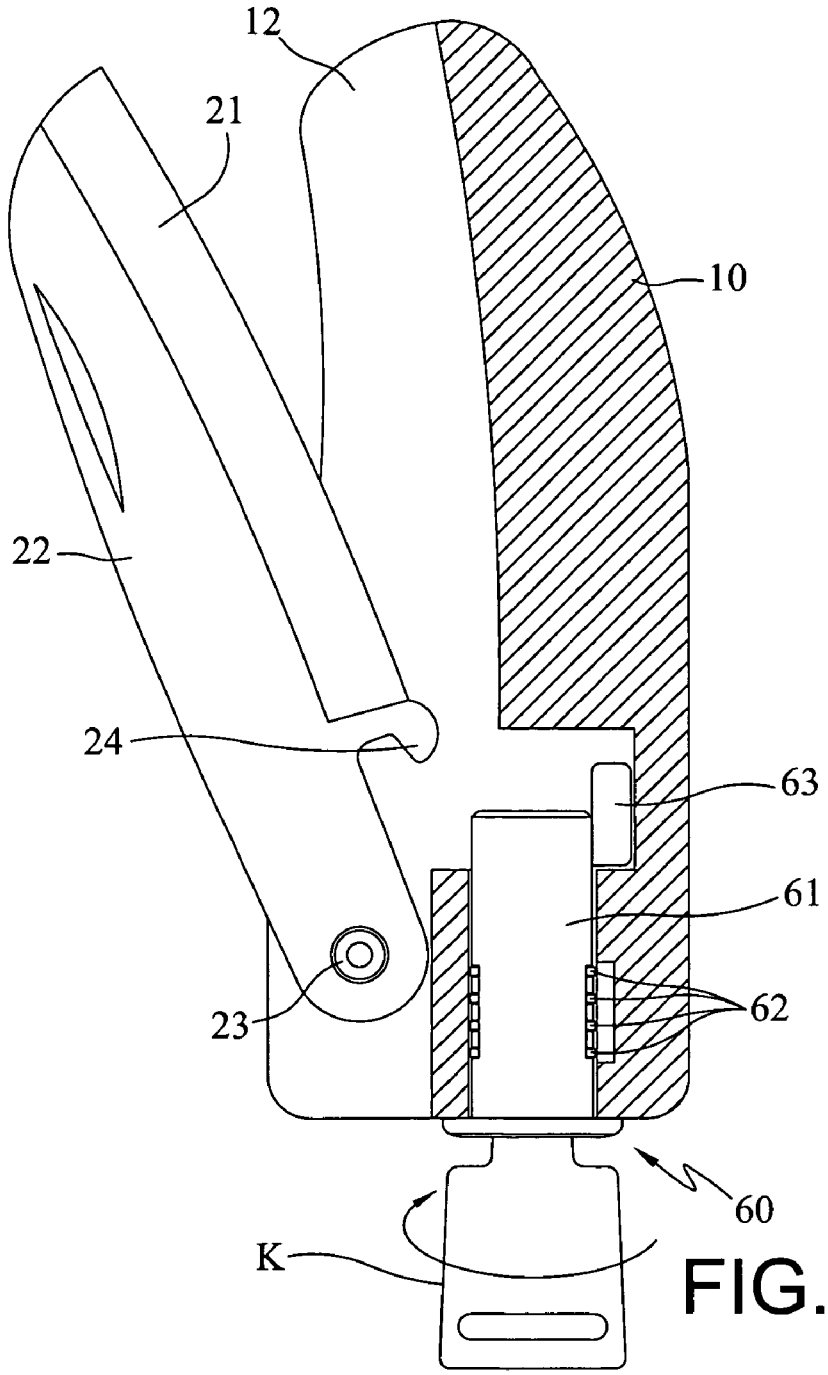
FIG. 16 is a constructional view of a seventh embodiment of the invention in which a cutting member is in a second position.

FIGS. 15 and 16 illustrate a seventh embodiment of the invention. The locking mechanism 60 is a key device including a key cylinder 61, a plurality of locking blades 62 extruding from side of the cylinder 61, and a stopper 63 formed on top of the cylinder 61. Correspondent to the locking mechanism 60, the receptacle 11 is formed with a slot for the locking blades 62 getting into and locking, as shown in FIG. 15, where the stopper 63 locks the limiting portion 24. As a result, the cutting member 20 is locked in the first position unless a key K being inserted in the keyhole (not shown in the drawing) operates the locking blades 62 retracting into the cylinder 61 to allow the cylinder 61 rotate to the release position as shown in FIG. 16. Then, the cutting member 20 can be moved. The composition and function of the locking mechanism 60 are of prior arts and will not further described in details herein.

EIGHTH EMBODIMENT

Figure 17:
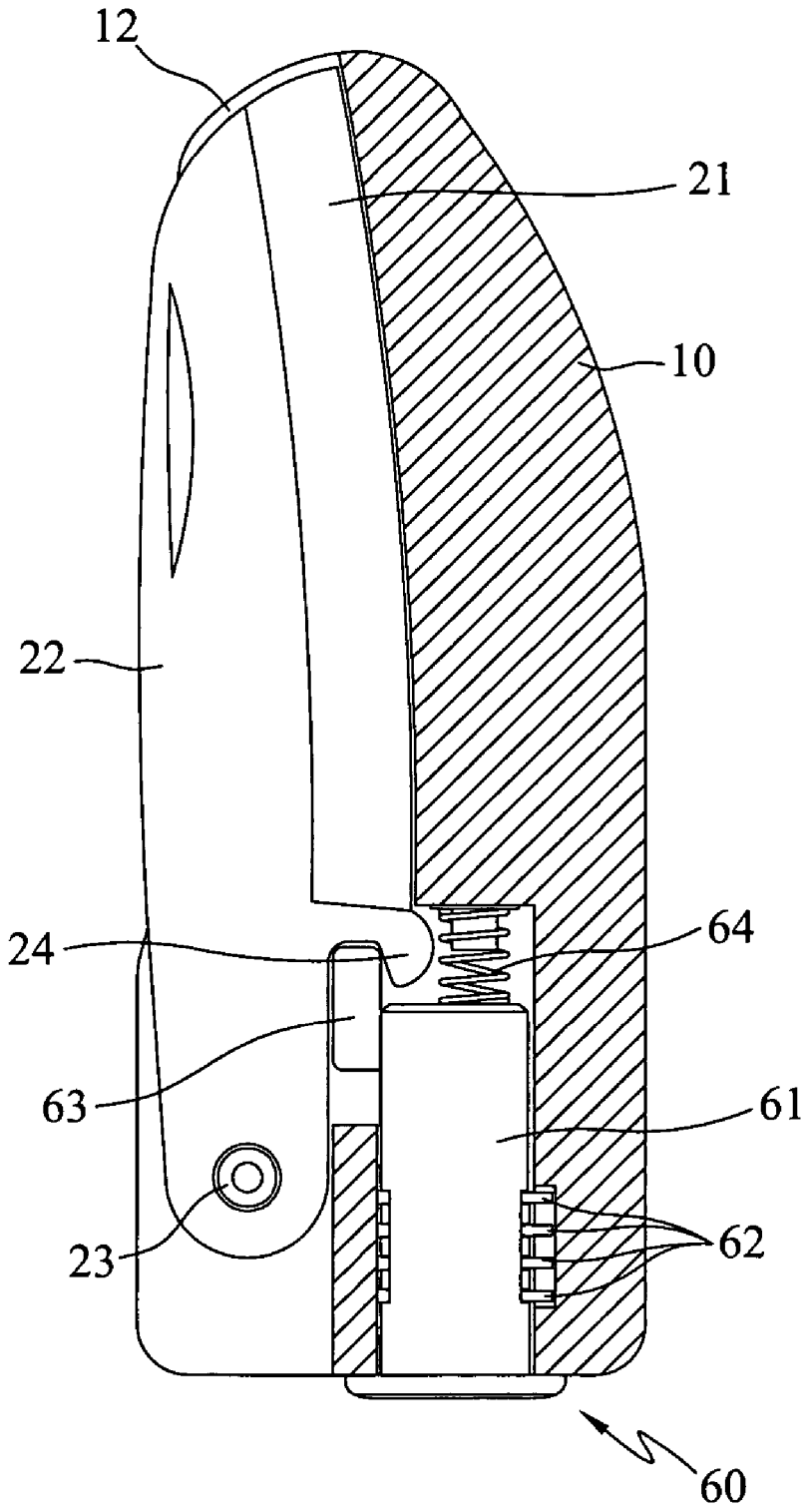
FIG. 17 is a constructional view of an eighth embodiment of the invention in which a cutting member is in a first position.
Figure 18:
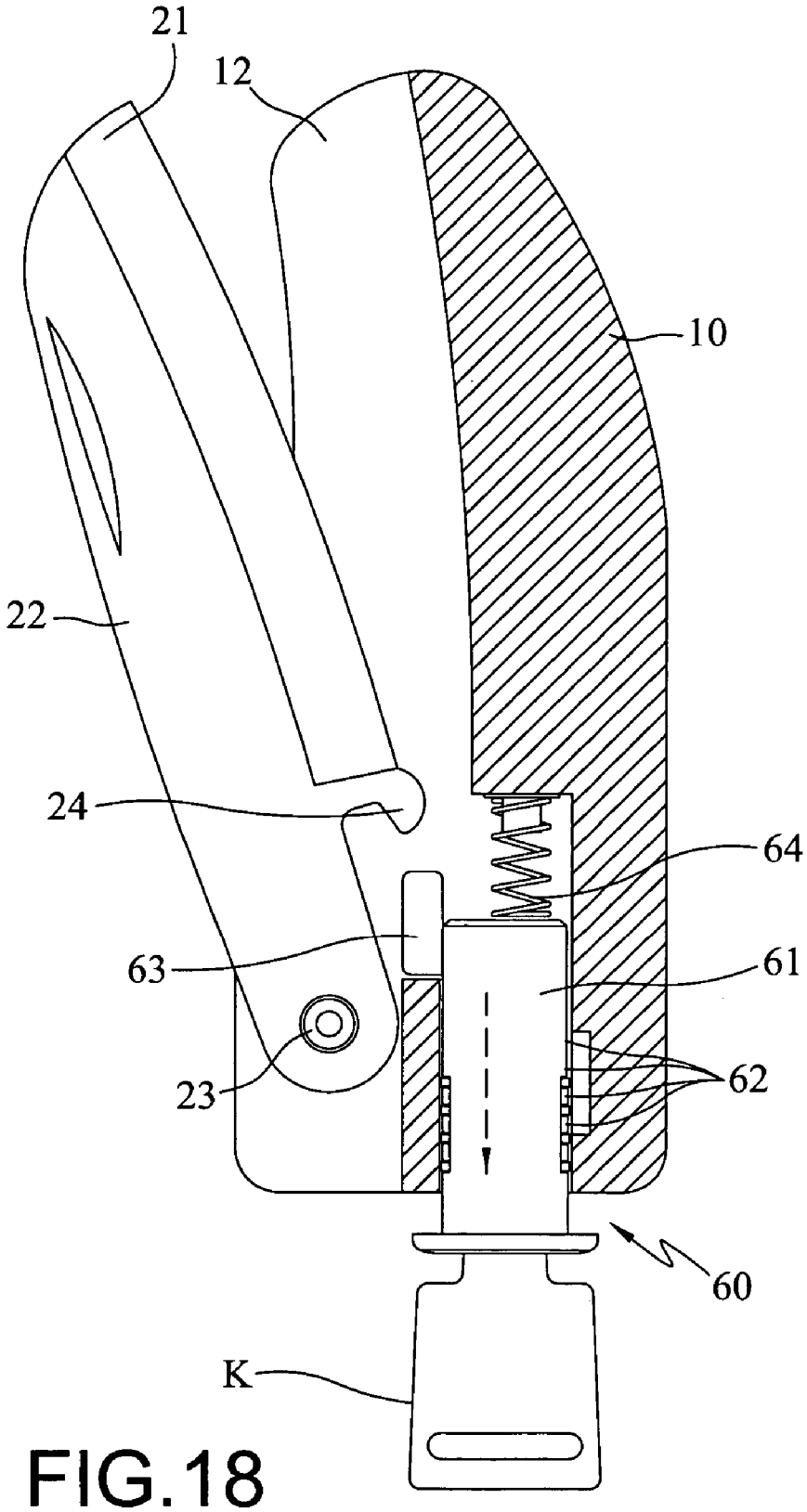
FIG. 18 is a constructional view of an eighth embodiment of the invention in which a cutting member is in a second position.

FIGS. 17 and 18 illustrate an eighth embodiment of the invention. In the seventh embodiment, the cylinder 61 changes its positions by rotation. In this embodiment, the cylinder 61 moves axially from a locking position (as shown in FIG. 17) to a release position (as shown in FIG. 18). The locking mechanism 60 in the embodiment further includes a resilient member 64 pressing on the cylinder 61 for providing the cylinder 61 a force toward the release position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tool device, comprising:

a main body, having a receptacle;

a cutting member, having an edge for cutting, and a limiting portion movably mounted on said main body, for selectively changing between a first position of being received in said receptacle, and a second position of being removed from said receptacle;

a locking mechanism, composed of a latch and a plurality of number wheels, said latch is formed with a pusher to be locked with said limiting portion when said latch is limited by said number wheels in a locking position, and to be moved to a release position to allow said cutting member to move and actuate said latch moving from said locking position to said release position;

a resilient member pressing on said latch for normally retaining said latch in said locking position; and a connecting member mounted between said pusher and said latch.

2. The tool device of claim 1, wherein said limiting portion has an inclined plane, and said connecting member has a ramp corresponding to said inclined plane to guide said cutting member to withdraw from said connecting member.

3. The tool device of claim 1, wherein said connecting member is formed with a knob.

4. The tool device of claim 1, wherein said limiting portion is formed near a pivot of said cutting member.

5. The tool device of claim 4, wherein said limiting portion is round and having two limiting sections of flat cutoffs on opposite sides, said latch comprises a slope corresponding to said limiting section so that when said latch is in a locking position, said limiting section flatly contacts said slope.

* * * * *